United States Patent [19]

Rowley et al.

[11] 3,966,363

[45] June 29, 1976

[54] PUMPING ASSEMBLY

[75] Inventors: William N. Rowley, Palos Verdes Estates; Gordon F. Ehret, Alhambra, both of Calif.

[73] Assignee: Weil-McLain Co., Inc., El Monte, Calif.

[22] Filed: Sept. 25, 1974

[21] Appl. No.: 509,121

[52] U.S. Cl. ..... 417/423 R; 415/170 A; 310/112

[51] Int. Cl.[2] ..... F04B 17/00; F04B 35/04

[58] Field of Search ..... 417/423 R, 373; 415/170 A; 310/112, 43, 104

[56] References Cited

UNITED STATES PATENTS

| | | | |
|---|---|---|---|
| 2,843,404 | 7/1958 | Janety | 415/170 A |
| 3,074,349 | 1/1963 | Zimmermann | 310/43 X |
| 3,203,353 | 8/1965 | Ruby | 417/373 X |
| 3,354,529 | 11/1967 | James | 415/170 A |
| 3,551,067 | 12/1970 | Wissman | 415/170 A |
| 3,576,380 | 4/1971 | Sargeant | 417/423 R |
| 3,594,102 | 7/1971 | Oden | 417/423 R |
| 3,614,272 | 10/1971 | Lightfoot et al. | 417/373 |
| 3,664,760 | 5/1972 | Reiner | 417/423 R |
| 3,791,773 | 2/1974 | Maginnis | 417/423 R |

*Primary Examiner*—Carlton R. Croyle
*Assistant Examiner*—Thomas I. Ross
*Attorney, Agent, or Firm*—Lane, Aitken, Dunner & Ziems

[57] ABSTRACT

A pump assembly in which a mounting bracket supports a pump housing relative to an electric motor with the output shaft of the motor extending through an opening formed in the pump housing. An electrical insulating seal plate extends between the housing and the mounting bracket to electrically insulate the two, and an impeller is mounted on the shaft and rotable therewith to pump water through the housing.

7 Claims, 4 Drawing Figures

PUMPING ASSEMBLY

BACKGROUND OF THE INVENTION

This invention relates to a pump assembly and, more particularly, to a pump assembly which is driven by an electrical motor for pumping water, or the like.

Electrically driven water pumps for use in systems in which persons physically contact the water in the system, such as in swimming pools, household water systems, lavatories, and the like, present potential safety hazards. This is largely due to the fact that any break down in the internal insulation of the motor can impart an electrical voltage to the output shaft of the motor which can be conducted through the shaft, the mounting bracket for the pump and motor, and the pump housing to the electrical conductive water supply.

Although various techniques have been proposed to insulate the drive shaft from the water in the system, these solutions have been less than completely effective. Also, even in situations where the output shaft of the electrical motor is effectively insulated from the water, a hazard still exists due to the possibility of current traveling from the motor through the metal mounting bracket and the pump housing to the water.

SUMMARY OF THE INVENTION

It is, therefore, an object of the present invention to provide a pump assembly of the above type which effectively isolates the electrical motor from the pump housing, and therefore, from the water contained in the housing.

It is a further object of the present invention to provide a pump assembly of the above type in which a seal plate is provided which separates the mounting bracket for the assembly from the pump housing and thus provides an effective insulation therebetween.

Towards the fulfillment of these and other objects, the assembly of the present invention comprises a pump housing defining an opening, an electrical motor having an output shaft, means for supporting said motor relative to said housing with a portion of said output shaft extending through said opening, an electrical insulating seal plate extending between said housing and said support means to insulate said housing from said support means, said seal plate defining an opening for receiving said shaft, and an impeller disposed in said housing and drivingly connected to said shaft to pump fluid through said housing.

DESCRIPTION OF THE PREFERRED EMBODIMENT

Figures 1, 3:
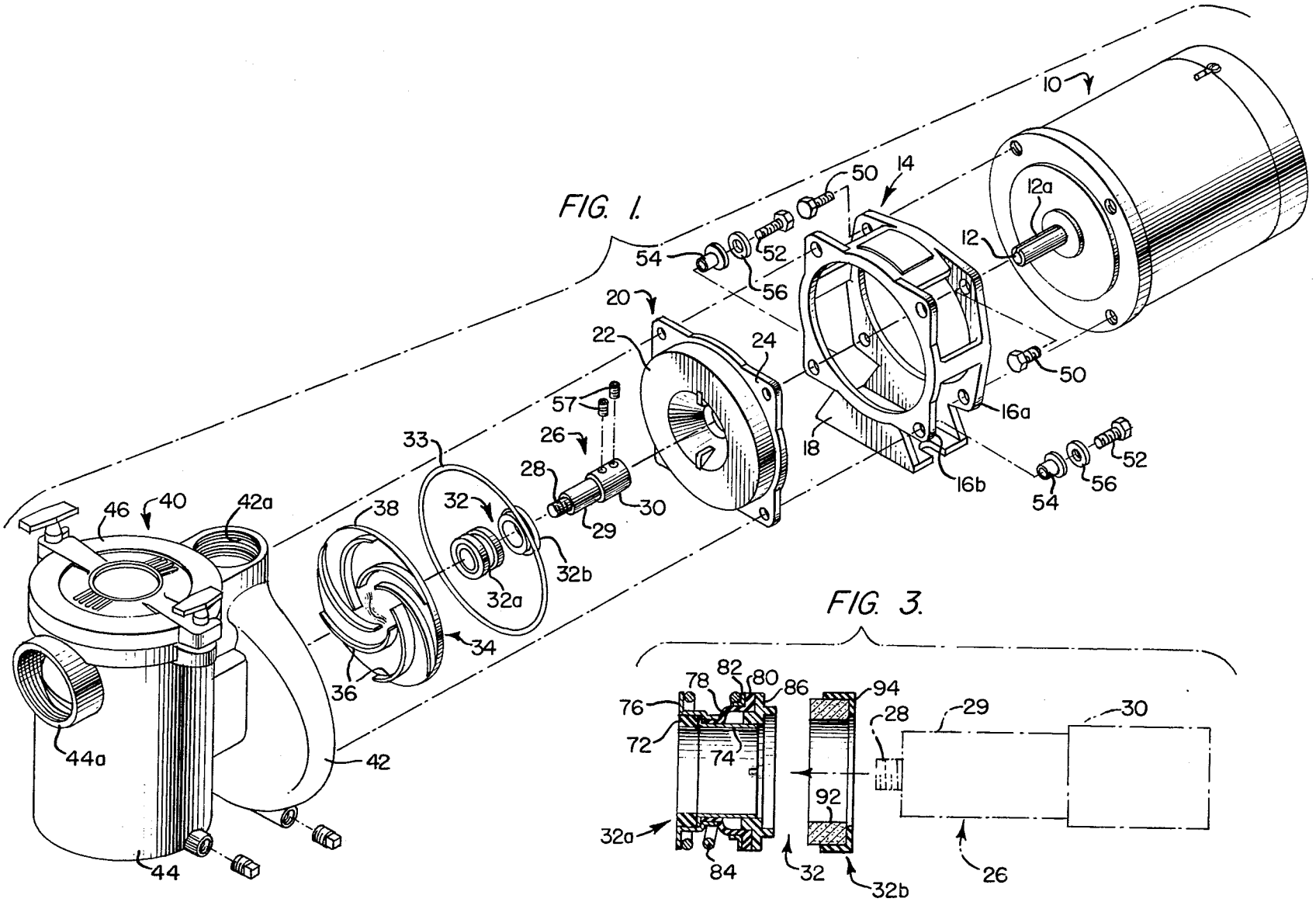
FIG. 1 is an exploded perspective view of the pump assembly of the present invention.
FIG. 3 is an exploded sectional view depicting a component of the assembly of FIGS. 1 and 2.

Referring to FIG. 1, the reference numeral 10 refers in general to an electrically operated motor having an output shaft 12 and being adapted to operate in a conventional manner in response to an electrical input, to drive the shaft. A metal mounting bracket 14 is provided for supporting the motor 10 and is of a generally cylindrical shape. A pair of mounting flanges **16*a* and 16*b* are formed at each end of the bracket 14 and extend from a base portion 18.**

A seal plate of a synthetic, dielectric material, is shown by the reference numeral 20 and includes a ring portion 22 and a mounting bracket 24. A central opening extends through the seal plate 20 in alignment with the output shaft 12. A stub shaft 26 is provided for connection to the output shaft 12 and includes an externally threaded portion 28, an intermediate portion 29, and an enlarged end portion 30 for extending over the output shaft.

A shaft seal assembly is shown in general by the reference numeral 32 and consists of two portions **32*a* and 32*b* for sealing and insulating the shaft 12 and stub shaft 26, as will be described in detail later. A face gasket, or O-ring, 33 extends around the disc portion 22 of the seal plate 20 for sealing same, and an impeller 34, also of a synthetic dielectric material, is provided for attachment to the stub shaft 26. The impeller 24 includes a plurality of arcuate blades 36 mounted on one face of a flat disc 38, the central portion of which is enlarged and internally threaded for receiving the threaded portion 28 of the stub shaft 26.**

A pump housing, shown in general by the reference numeral 40, includes a volute or pumping portion 42 which has an opening (not shown in FIG. 1) formed through its rear face for receiving the impeller 34, and an outlet **42*a*. An inlet portion 44 is provided which defines a chamber in communication with the volute portion 42 and has an inlet opening 44*a*. A lid 46 is provided for the top of the inlet portion 44, it being understood that a filter basket or other type filter device can be provided in the inlet portion 44. The inlet opening 44*a* and the outlet opening 42*a* are adapted to be connected to pipes, hoses, or the like, so that water can be pumped from the opening 44*a* through the inlet portion 44, the volute portion 42, and out through the outlet opening 42*a* under the action of the impeller 34.**

Several connectors are provided for the foregoing assembly and include a plurality of bolts 50 for connecting the flange **16*a* on the mounting bracket 14, to the housing of the motor 10. Also, a plurality of bolts 52 connect the flange 16*b* on the mounting bracket 14 and the flange 24 on the seal plate 20 to the volute housing 42, with the bolts 50 and 52 extending through corresponding opening formed in the respective brackets, as shown. A sheath, or sleeve, 54 of a synthetic dielectric material is provided through which the shank of each bolt 52 extends, with a washer 56 disposed therebetween, in order to electrically insulate the bolts from the mounting bracket 14. A pair of set screws 57 are provided which extend through threaded bores in the stub shaft 26 and which engage a slot 12*a* formed in the output shaft 12 for securing the stub shaft 26 to the output shaft 12.**

Figure 2:
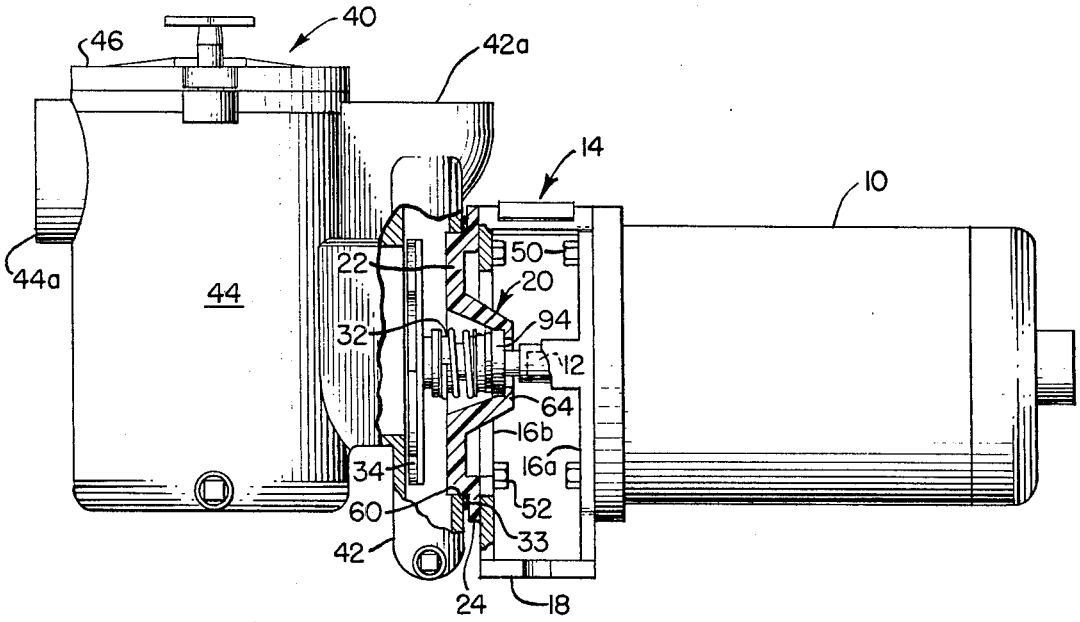
FIG. 2 is a partial elevational, partial sectional view depicting the pump assembly of FIG. 1 in an assembled condition.

The assembly of FIG. 1 is shown in an assembled condition in FIG. 2 with the motor 10 and the pump housing 40 being mounted to the bracket 14 as described above. It is noted that, in the assembled condition, the ring shaped portion 22 of the seal plate 20 extends in an opening 60 provided in the volute housing 42, with the outer periphery of the portion 22 in engagement with the wall defining the latter opening. Also, the O-ring 33 extends around the ring portion 22 and between the bracket 24 and the corresponding face of the pump housing 40. Further, the seal shaft assembly 32 extends from the impeller 34, through an enlarged opening in the seal plate 20 and abuts against the inner face of a hub 64 integral with the seal plate 20.

The shaft seal assembly 32 is shown in detail in FIG. 3 and includes a first portion 32*a* which is formed by an internal washer 72 and a metal sleeve 74 abutting the washer 72. A flanged sleeve 76 extends over the washer 72 with the corresponding faces of each being adapted to engage the rear face of the impeller 34. A flexible, bellows-like sleeve 78 is provided which has one end portion pressed between the sleeve 74 and the sleeve 76, and a flange 80 formed at the other end portion which is engaged by a rigid support ring 82. A compression spring 84 extends between the sleeve 76 and the support ring 82 and a washer 86 of a relatively hard plastic has a ring portion extending within the flange 80 of the sleeve 78 and a flanged portion abutting the flange 80. As a result of the foregoing arrangement, the spring 84 urges the sleeve 78 into its expanded condition for reasons to be described later. The second portion 32*b* of the assembly 32 consists of a ceramic washer 92 having a cup-shaped seal member 94 extending over a portion of its outer periphery and a portion of its rear face.

In use, the impeller 34 is affixed to the threaded portion 28 of the stub shaft and the shaft seal portions 32*a* and 32*b* extend over the intermediate portion 29 of the stub shaft 26 and between the impeller and the inner face of the hub section 64. The spring 84 is thus loaded to an extent that the shaft seal portion 32*a* is secured relative to the shaft 26. The seal member 94 of the shaft seal portion 32*b* engages the inner face of the hub portion 64 of the seal plate and thus remains fixed to insure a proper seal. When the shaft 12, and therefore the stub shaft 26, rotates, a circular flange formed on the rear face of the washer 86 rubs against the ceramic washer 92 with minimum friction. As noted above, the washers 72 and 86 and the sleeve 78 are of a dielectric material, such as plastic or rubber, to electrically insulate the stub shaft 26 and therefore the shaft 12 from the remaining portion of the assembly.

Figure 4:
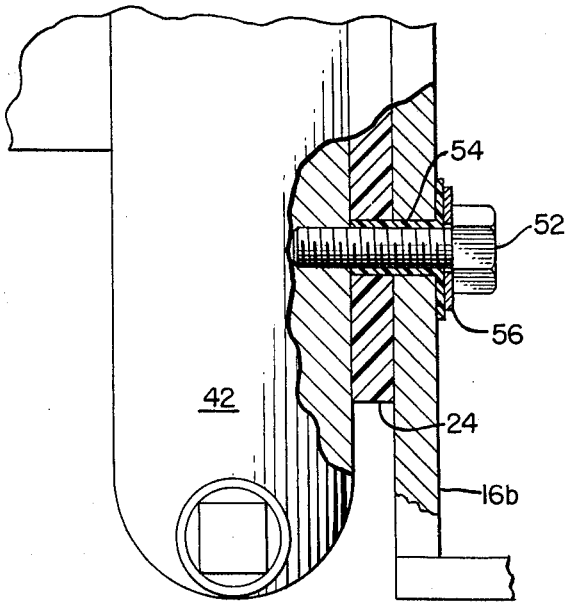
FIG. 4 is an enlarged partial elevational view of the assembly of FIGS. 1 and 2 with a selected portion thereof being shown in cross section.

FIG. 4 depicts a cross-section of the mounting between the volute housing 42, the flange 24 of the seal plate 20, and the flange 16*b* of the mounting bracket 14. In particular, one of the above-mentioned sleeves 54 of synthetic, dielectric material, is shown extending through aligned openings provided in the brackets 24 and 16*b,* and the shank of the bolt 52 extends within the latter sleeve and into a threaded opening provided in the volute housing 42. A washer 56 extends between the inner face of the head of the bolt 52 and a flanged portion of the sleeve 54 to insure complete insulation.

It is understood that the dielectric synthetic material used in connection with the seal plate 20, the impeller 34, and the sleeve 54 can be of several types, such as a fiberglass reinforced plastic or other equivalent material.

As a result of the foregoing, the electrical motor 10, and particularly its output shaft 12, is electrically insulated from the volute housing 42 by the shaft seal assembly 32, the seal plate 20, and the sleeves 54.

Of course, other variations of the specific construction and arrangement of the pumping assembly disclosed above can be made by those skilled in the art without departing from the invention as defined in the appended claims.

We claim:

1. A pump assembly comprising a pump housing defining an opening, an electrical motor having an output shaft, means for supporting said motor relative to said housing with a portion of said output shaft extending through said opening, a seal plate of a dielectric material, at least a portion of said seal plate extending between said housing and said support means for insulating said housing from said support means, a plurality of sleeves of dielectric material extending through corresponding openings in said seal plate and said support means, a bolt extending through each sleeve and into said housing to connect said seal plate and said support means to said housing, said seal plate defining an opening for receiving said shaft, and an impeller disposed in said housing and drivingly connected to said shaft to pump fluid through said housing.

2. The assembly of claim 1 further comprising seal means cooperating with said shaft for preventing the leakage of fluid from said housing.

3. The assembly of claim 2 wherein said seal means includes a first portion secured to said shaft and a second portion secured relative to said seal plate and permitting rotation of said shaft.

4. The assembly of claim 1 wherein said impeller is of a dielectric material.

5. The assembly of claim 1 wherein a surface of said seal plate engages the wall of said housing defining said opening in said housing.

6. A pump assembly comprising a pump housing defining an opening, an electrical motor having an output shaft, means for supporting said motor relative to said housing with a portion of said output shaft extending through said opening, a seal plate of a dielectric material having an annular portion extending within said opening with the outer surface of said annular portion in engagement with the inner wall of said housing defining said opening, said seal plate having a flange portion integral with said annular portion and extending between said housing and said support means for insulating said housing from said support means, said seal plate defining an opening for receiving said shaft, a plurality of sleeves of dielectric material extending through corresponding openings in said flange portion and said support means, a bolt extending through each sleeve and into said housing to connect said flange portion of said seal plate and said support means to said housing, an impeller of a dielectric material disposed in said housing and drivingly connected to said shaft to pump fluid through said housing, and a seal assembly cooperating with said shaft for preventing the leakage of fluid from said housing, at least a portion of said seal assembly being of a dielectric material for insulating said shaft from the fluid in said housing.

7. The assembly of claim 6 wherein said seal assembly includes a first portion secured to said shaft and a second portion secured relative to said seal plate and permitting rotation of said shaft.

* * * * *